US005917780A

United States Patent [19]

Berestov

[11] Patent Number: 5,917,780

[45] Date of Patent: Jun. 29, 1999

[54] WATCH HAVING A MULTIPLICITY OF BAND ATTACHMENT POSITIONS AND WRISTBAND FOR USE THEREWITH

[75] Inventor: Alexander L. Berestov, Tempe, Ariz.

[73] Assignee: Daniel Robbins, San Diego, Calif.; a part interest

[21] Appl. No.: 08/984,579

[22] Filed: Dec. 3, 1997

[51] Int. Cl.[6] ..... G04B 37/00; A44C 5/00

[52] U.S. Cl. ..... 368/282

[58] Field of Search ..... 368/281, 282; 224/168–181

[56] References Cited

U.S. PATENT DOCUMENTS

| | | | |
|---|---|---|---|
| D. 284,170 | 6/1986 | Kurimora . | |
| 300,286 | 6/1884 | Salisbury . | |
| 1,852,016 | 4/1932 | Kent | 368/323 |
| 2,229,978 | 1/1941 | Kolberg | 368/321 |
| 2,394,856 | 2/1946 | Hickman | 368/322 |
| 2,398,723 | 4/1946 | Schmidt | 368/322 |
| 2,801,779 | 8/1957 | Jenkins | 368/322 |
| 5,779,113 | 7/1998 | Huang | 368/322 |

OTHER PUBLICATIONS

Newspaper Advertisement "Burdines" The Bon Marche *(No Date).

Print of Watch Made in Hong Kong.* (No Date).

*Primary Examiner*—Bernard Roskoski
*Attorney, Agent, or Firm*—Daniel Robbins

[57] ABSTRACT

Rather than having only two diametrically opposed band attachment points on a watch case and a single strap watchband, a watch has multiple attachment points at opposite edges of its watch case, and a watchband with multiple branches for fastening to the watch case's multiple attachment points. These branches may be straps fabricated of materials such as fabric, leather, metal or flexible plastics, and buckles and other appropriate fastening devices are integral with the strap. The multiple branch band also may be a continuously expandable linkage structure which attaches to the case, and which expands over the hand and then contracts to comfortably hold the watch on the wrist, or a metallic band having a central clasp for securing the watch to the wrist. A multiple band watchband for attachment to two opposing edges of a watch case is also disclosed.

21 Claims, 5 Drawing Sheets

WATCH HAVING A MULTIPLICITY OF BAND ATTACHMENT POSITIONS AND WRISTBAND FOR USE THEREWITH

BACKGROUND OF THE INVENTION

1. Field of the Invention

This invention relates to a wristwatch, and in particular to a watch and band for securing the watch to a wearer's wrist.

2. Description Relative to the Prior Art

The watch chronometer has a long and colorful history. According to the WORLD BOOK ENCYCLOPEDIA, watches first appeared in the early 1500's, made possible by the invention of the mainspring. They were bulky, heavy and inaccurate, and were usually worn around the neck or belt suspended by a cord or chain. Within the next 100 years, watches became smaller and by the late 1600's could be carried in a pocket of a jacket or vest. The pocket watch was in vogue for the next 200 years, and it was not until the late 1800's that the wristwatch came into common use, and has remained the watch of choice ever since. It is estimated that over sixty million watches, mostly wristwatches, are sold annually in the United States.

While the "works" of the watch, i.e. the time keeping mechanism contained within the "case" of the watch, has evolved in a spectacular manner, the geometry of the basic case of the wristwatch, and the way the case is attached to the wrist has substantially remained the same ever since the wristwatch was invented. Modern works may include precision mechanical assemblies or sophisticated electronic circuits driving minute and second hands, mechanical displays, electronic analog displays or digital displays. However, the case is still a substantially flat (or sometimes slightly curved) enclosure generally having a circular, elliptical or quadrangular cross-section for containing the mechanism, and usually having two band attachment positions located diametrically opposed to each other on side edges of the case, with a single band for wrapping around the wearer's wrist. In FIG. 1, a watch and band 10, as most commonly practiced in the art, has a case 12 with two band attachment points 14, 16, and a single wristband 18 secured to the case 12. In the disclosure of the present invention, multiple band attachment points are defined to be a number of attachment points greater than two. As shown in FIG. 2, some watch cases known in the art may have two attachment points 22,24 and 28, 30 on each of the edges of the case 32,34. Other watch cases known in the art have other multiple attachment points on the case's opposing edges, but it will be noted that the prior art only teaches equal number of attachment points at opposite edges of the watch case. For example, referring to FIG. 5, a multiple strap watchband 62 is disclosed which may be used with the watch e.g. 20, of FIG. 2. The watchband 62 has straps 64, 66 which have an axle 70 running through loops at the straps' ends, securing the ends along a common line. At their ends, the straps 64,66 are mounted on the axle 70, and buckles 72,74 are rotatably mounted on the axle 70. The straps 64,66 have loops 76, 78 at their ends opposite to the axle 70, which are attachable to the attachment points of the case of the watch. The mating portion of the watchband 62 has straps 82,84 with end loops 86,88 for securing to the appropriate attachment points of the case of a watch. The tongue ends 90,92 of the straps 84,82 mate with, and are secured by, the buckles 72,74 when the band 62 encircles the wearer's wrist. It will be noted that the watchband 62 has the same number of straps for connection at the opposite locations on the watch's case, i.e. 2 straps, and accordingly the buckles may be placed at the ends of corresponding straps as shown in FIG. 5 It is towards the improvement of the wristwatch having such case structure, and the band securing it to the wrist that the present invention is directed.

SUMMARY OF THE INVENTION

Rather than having equal numbers of diametrically opposed band attachment points located at opposite edges of a watch case, as disclosed in the prior art, the present invention teaches the use of multiple band attachment points located at opposite edges of a watch case where the number of attachment points on the edges opposite to each other are not equal to each other. Practice of the invention also teaches use of a watchband having multiple branches compatible for fastening to the disclosed watch case's multiple attachment points. These branches may be straps fabricated of materials such as fabric, leather, metal or flexible plastic, and buckles and other appropriate latching devices are part of the straps. The multiple branch band also may be a continuously expandable linkage structure which attaches to the case and which expands over the hand and then contracts to comfortably hold the watch on the wrist, or a non-expanding metallic band having a central clasping mechanism for securing the watch to the wrist. Accordingly, the invention accommodates a wide variety of strap configurations and strap fastening techniques, and the teachings of the invention increase the range of novel, useful and artistic features available in the design of the wristwatch.

BRIEF DESCRIPTION OF THE DRAWINGS

The prior art, and the invention will be described with respect to the drawings of which.

DESCRIPTION OF THE PREFERRED EMBODIMENTS

Figure 1:
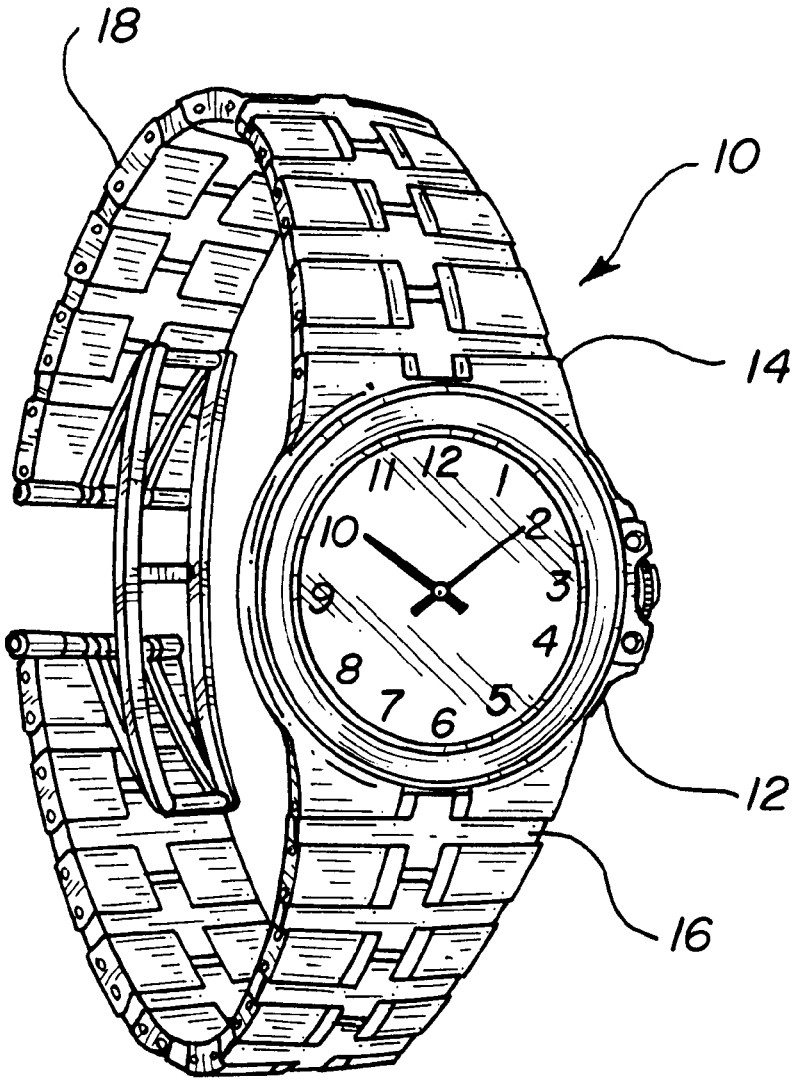
FIG. 1 PRIOR ART
FIG. 1 is a drawing of a wristwatch and band known in the prior art.
Figure 2:
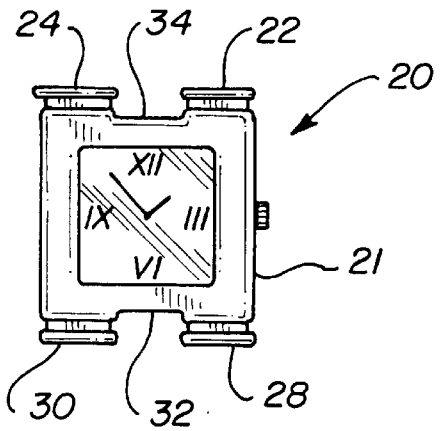
FIG. 2 PRIOR ART
FIG. 2 is a drawing of a watch known in the prior art.
Figure 3:
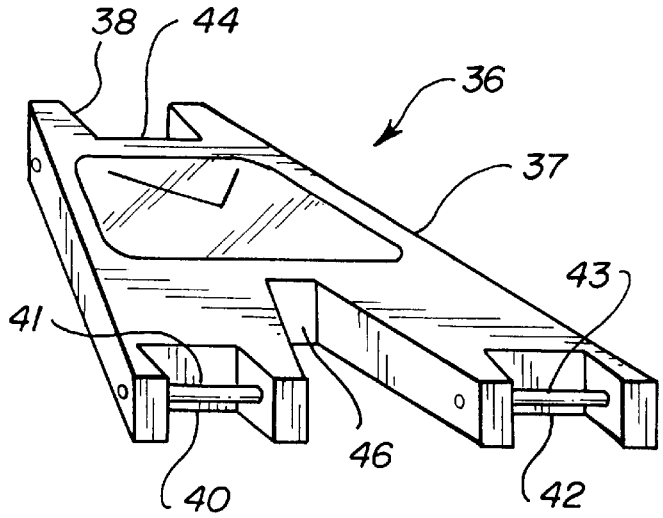
FIG. 3 is a drawing of a watch illustrating the invention.

In accordance with the invention, FIG. 3 illustrates a watch 36 that has one attachment point 38 on the edge 44 of the case 37, and two attachment points 40,42 on the opposing edge 46 of the case 37. The attachment points 38,40,42 preferably consist of brackets in the case 37 having spring loaded pins 41,43 (the corresponding pin in the attachment point 38 is not visible in the drawing) to which the ends of the wrist bands are secured, as will be described below.

Figure 4:
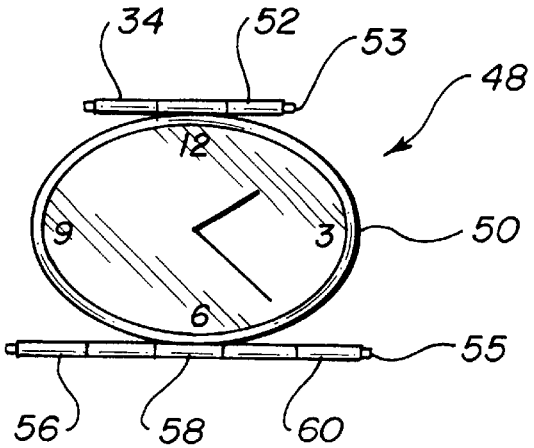
FIG. 4 is a drawing of a second watch in accordance with the invention.
Figure 5:
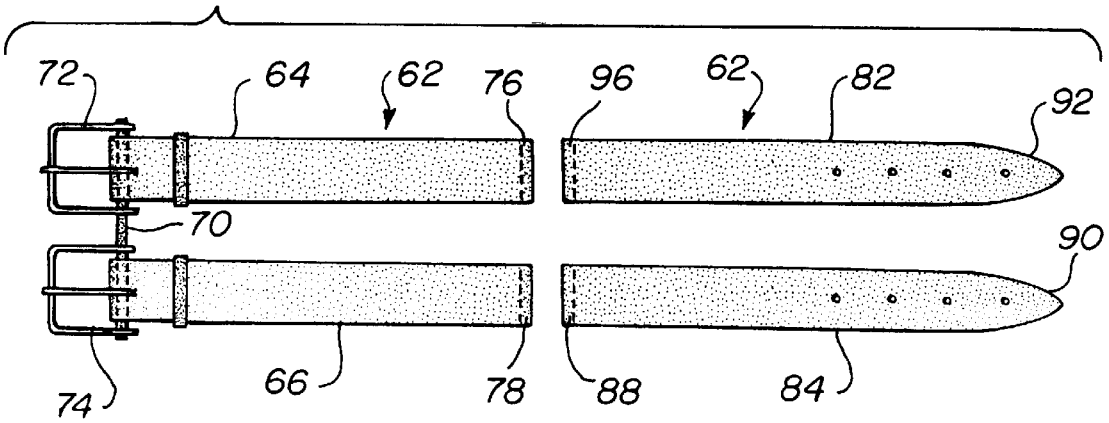
FIG. 5 PRIOR ART
FIG. 5 is a drawing of a watch band known in the art.

In the practice of the invention it is to be noted, by definition, that the case of a watch, e.g. 37, is to include the entire structure of the watch to which the band elements are attachable. This includes wristwatches where the band of the watch may merge into the case in a substantially smooth transition; the multiple attachment points are specified as the places where the multiple straps of the band become separated from one another and merge into the case. As a further example, in FIG. 4 a watch 48 has a case 50 which includes the multiple attachment points 52, 54, 56, 58 and 60. The attachment points 52, 54 may be implemented on an axle 53 whose diameter is reduced at the attachment points 52, 54 to provide shoulders which restrain the band to remain at the attachment points 52, 54, while similarly an axle 55 has three reduced diameter sections which serve as the attachment points 56,58,60.

Figure 10:
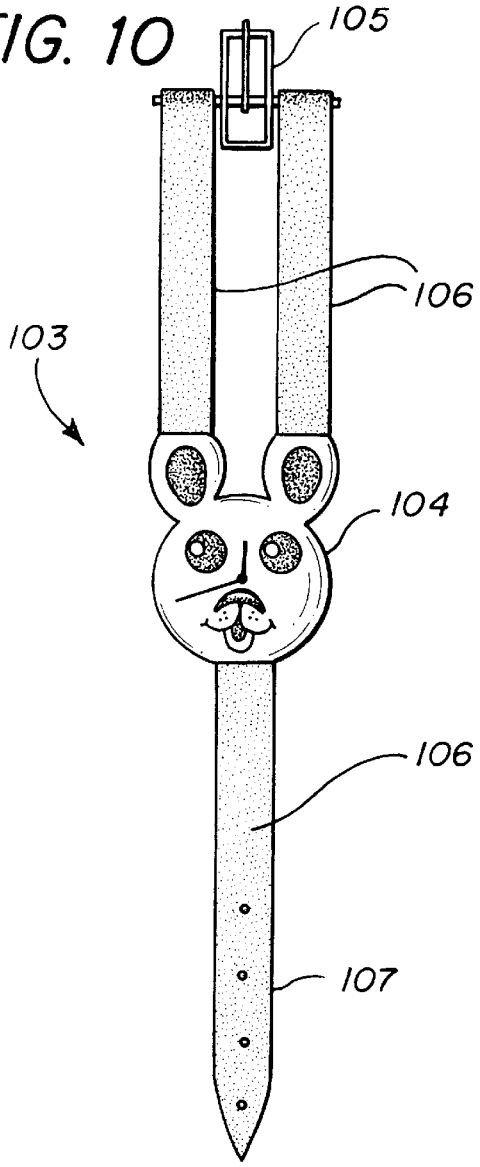
FIGS. 10–12 are drawings of wristwatches in accordance with the invention.
Figure 11:
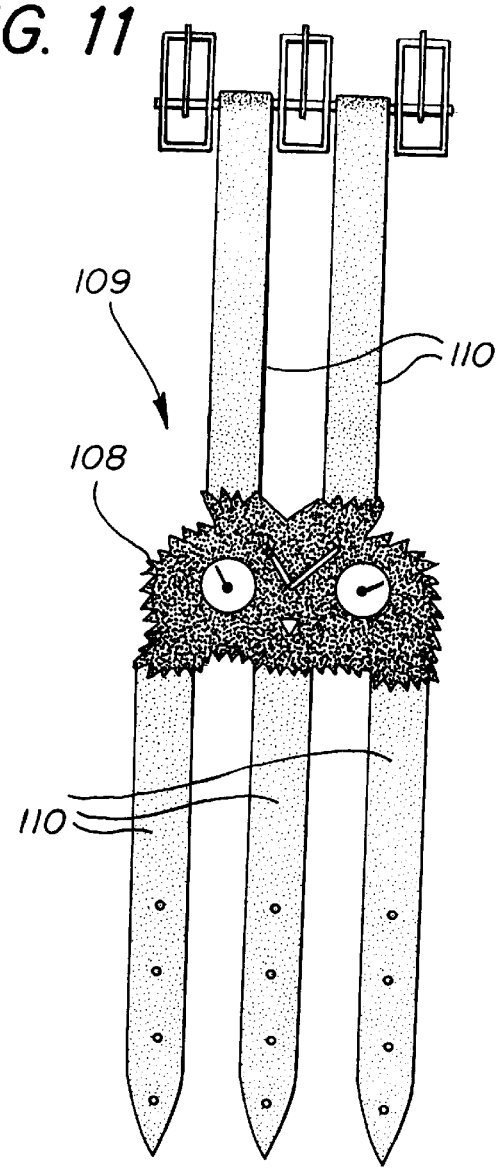

It will be appreciated that other watchband configurations are possible in which the number of straps at the opposite attachment locations are different. FIGS. 10–11 illustrate such configurations wherein a buckle may be placed either between the straps (FIG. 10), or between the straps or outboard of the straps (FIG. 11).

Figure 6:
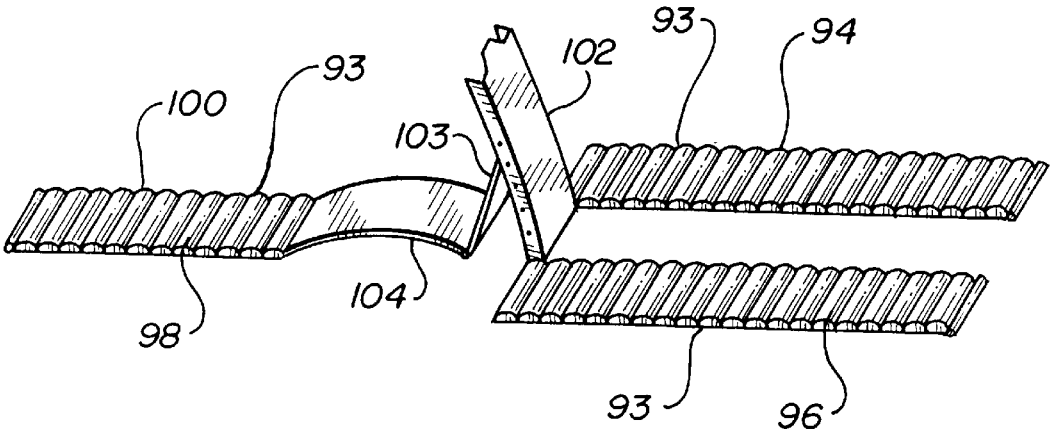
FIGS. 6–9 are drawings of watchbands in accordance with the invention.

Referring to FIG. 6, another embodiment of a multiple strand band 93 consists of metallic elements e.g. 94,96,98 linked together in a manner known in the art. When used with a watch having multiple attachment points as disclosed in the invention, a clasp, having three interlocking parts 102, 103, 104 latches to secure the band 93 about the wrist.

Figure 7:
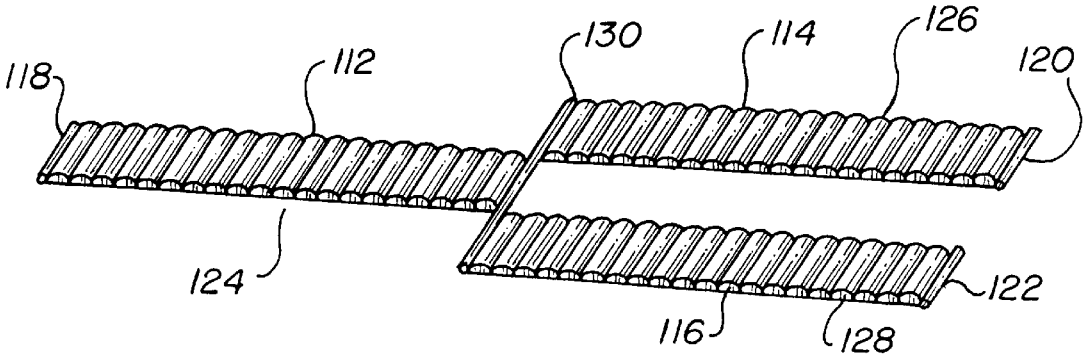

The application of the invention to a watchband having elastically coupled elements e.g. 112,114,116 is shown in FIG. 7. The elements, e.g. 112, 114, 116 may be joined together by springs or other elastic means in a manner known in the art. The multiple straps 124,126,128 are shown joined at an axle 130, and the ends 118,120,122 are for connection to the attachment points of a watch case. When used on a wristwatch, such a watchband forms a continuous band which expands to slip over the hand and then retracts about the wrist of the wearer.

Figure 8:
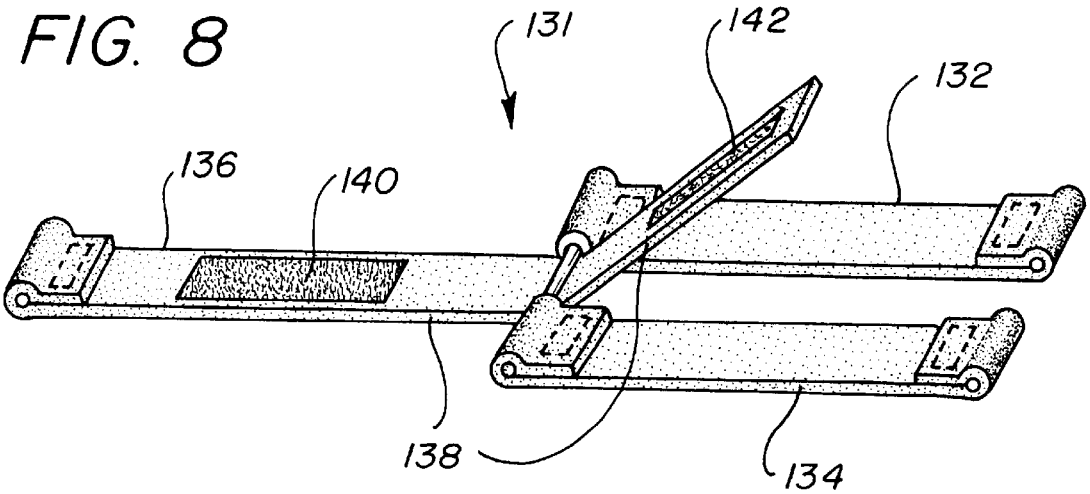

Referring to FIG. 8, a watchband 131 consists of straps 132,134,136 having a central clasp 138 which is secured by use of VELCRO mating strips 140,142.

Figure 9:
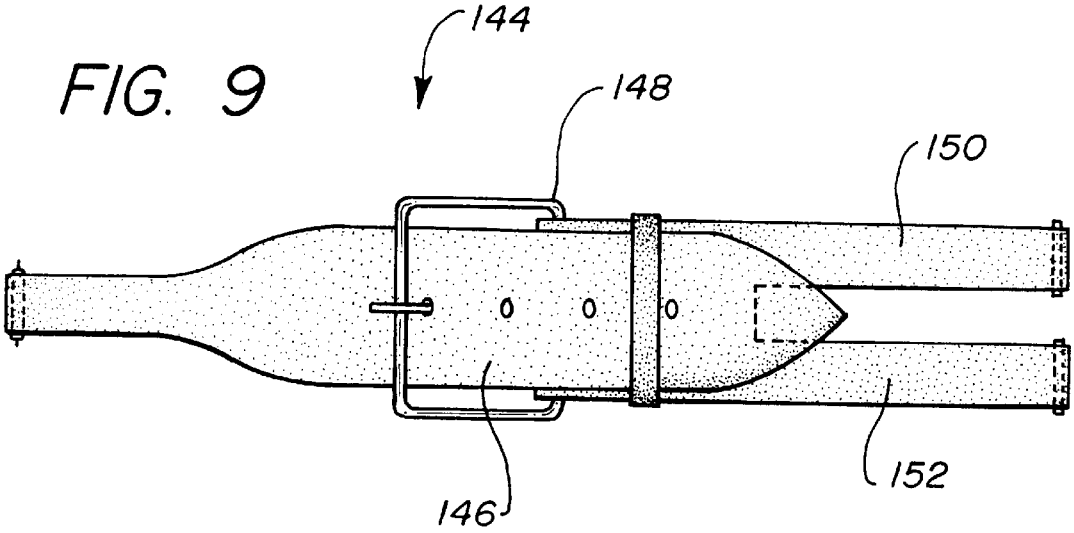

FIG. 9 illustrates a watchband 144 using a single tongue member 146 which mates with a single buckle secured to several straps 150 152.

Figure 12:
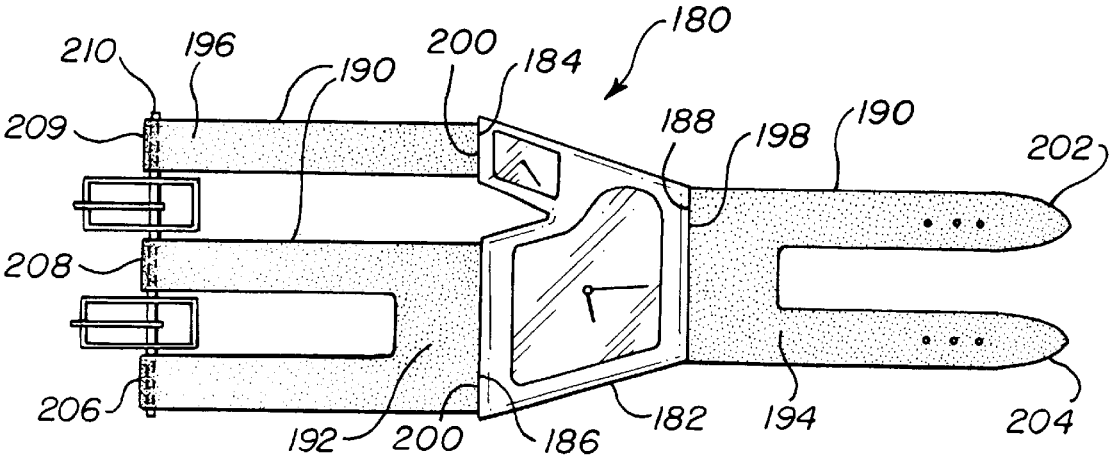

Referring to FIG. 10, a wristwatch 103, utilizes a watch 104 and a multiple strand band 106 both structured in accordance with the teachings of the invention. The multiple 3 strand band 106 is shown attached to the watch case 104, and uses a single buckle 105 to mate with the tongue 107. The wristwatch 107 of FIG. 11 consists of a watch 108 and a multiple 5 strand band 110. FIG. 12 illustrates another band structure as part of a wristwatch 180. The watch case 182 has 3 attachment points 184,186,188 and a multiple strand band 190 consisting of the 2 strands 192, 194. One end of the strand 194 is attached to the watch case 182 at attachment point 188, while the 2 other ends 202,204 of the band 194 are tongues. The ends 200 of the strand 192 is attached to the opposite side of the watch case 182 at attachment points 184,186. The opposite ends 206,208,209 of the strand 192 are attached to an axle 210, and buckles 212,214 are also located on the axle 210 at the positions mating with the tongues 202,206. While the wristwatches 103, 107, 180 of FIGS. 10,11,12 are shown with bands having tongue and buckle fastening devices, it will be appreciated that other band structures, such as illustrated in FIGS. 6, 7, 8 and 9, may be used in implementing the teachings of the invention as bands for the wristwatches of FIGS. 10,11,12.

The invention has been described in detail with particular reference to preferred embodiments thereof, but it will be understood that variations and modifications can be effected within the spirit and scope of the invention.

What is claimed is:

1. A watch comprising a case, said case further comprising multiple points of attachment along a contour of said case, whereby a watchband comprising a number of separate branches equal to the number of said multiple points is attachable to said case, wherein at least one of said multiple points of attachment is located at a first position of said contour of said case, and at least two of said multiple points of attachment are located at a second position of said contour of said case, said second position being located substantially opposite said first position, and further wherein the number of said points of attachment located at said first position is unequal to the number of said points of attachment located at said second position.

2. The watch of claim 1 wherein said points of attachment further comprise:

a) bracket means attached to said case, and b) spring loaded pin means for insertion into said bracket means, whereby said spring loaded pin means secures said watchband to said case.

3. The watch of claim 1 wherein said points of attachment further comprise:

a) at least one axle attached to said case, b) multiple shoulders on said at least one axle whereby said branches of said watchband may be positioned on said axle against said shoulders to effect connection to said case.

4. A watchband comprising:

a) a multiplicity of bands, said bands each having first and second ends, b) at least one band of said multiplicity of bands adapted for connection of said first ends to a first location of the case of an associated watch, and c) at least two additional bands of said multiplicity of bands adapted for connection of said first ends to a second location of said case of said associated watch.

5. The watchband of claim 4 wherein said first of at least one band includes means for latching for connection of said second ends of said of at least one band to said second ends of said at least two additional bands.

6. The watchband of claim 4 wherein said bands comprise metallic elements interconnected by spring means wherein said watchband is longitudinally expandable and retractable.

7. The watchband of claim 4 wherein said bands comprise interconnected metallic elements, and further wherein said second ends are attached to at least one central clasp whereby by closing said at least one clasp said watchband may serve as the watchband of a wristwatch.

8. The watchband of claim 5 wherein said means for latching comprises buckles located at said second ends of said at least one band, and tongues for mating with said buckles at said second ends of said of at least two additional bands.

9. The watchband of claim 5 wherein said means for latching comprises buckles positioned on an axle located at said second ends of said at least one band, and tongues for mating with said buckles at said second ends of said at least two additional bands.

10. The watchband of claim 4 wherein said bands are fabric.

11. The watchband of claim 4 wherein said bands are flexible plastic.

12. The watchband of claim 5 wherein said means of latching are mating VELCRO sections attached to said bands.

13. A wristwatch comprising:

a) a case, b) said case having at least one attachment point located at a first location on the contour of said case, c) said case further having at least two attachment points located at a second location on said contour of said case, said second location being substantially opposite said first location, wherein the number of said attachment points at said first location is unequal to the number of attachment points at said second location, d) a watchband comprising a plurality of bands, said bands having first and second ends, e) said plurality of bands comprising at least one band having said first end attached to said at least one attachment point, f) said plurality of bands further comprising at least two bands having said first ends attached to said at least two attachment points, and g) latching means for mutually securing said second ends of said plurality of bands.

14. The wristwatch of claim 13 wherein said latching means includes means for latching said second ends of said at least one band to said second ends of said plurality of bands attached to said at least two attachment points.

15. The wristwatch of claim 13 wherein said means for latching said second ends comprises buckles located at said second ends of said at least one band and tongues for mating with said buckles at said second ends of said plurality of bands attached to said least two attachment points.

16. The wristwatch of claim 13 wherein said means for latching comprises buckles positioned on an axle located at said second ends of said at least one band, and tongues for mating with said buckles at said second ends of said at least two bands.

17. The wristwatch of claim 13 wherein said bands comprise metallic elements interconnected by spring means wherein said watchband is longitudinally expandable and retractable.

18. The wristwatch of claim 13 wherein said bands comprise interconnected metallic elements, and further wherein said second ends are attached to at least one central clasp whereby by closing said at least one clasp said watchband may serve as the watchband of a wristwatch.

19. The wristwatch of claim 13 wherein said bands are fabric.

20. The wristwatch of claim 13 wherein said bands are flexible plastic.

21. The wristwatch of claim 13 wherein said means of latching are mating VELCRO sections attached to said bands.

* * * * *